US010810986B2

(12) United States Patent
Maezawa

(10) Patent No.: US 10,810,986 B2
(45) Date of Patent: Oct. 20, 2020

(54) AUDIO ANALYSIS METHOD AND AUDIO ANALYSIS DEVICE

(71) Applicant: Yamaha Corporation, Hamamatsu, Shizuoka (JP)

(72) Inventor: Akira Maezawa, Shizuoka (JP)

(73) Assignee: YAMAHA CORPORATION, Shizuoka (JP)

( * ) Notice: Subject to any disclaimer, the term of this patent is extended or adjusted under 35 U.S.C. 154(b) by 0 days.

(21) Appl. No.: 16/393,592

(22) Filed: Apr. 24, 2019

(65) Prior Publication Data

US 2019/0251940 A1 Aug. 15, 2019

Related U.S. Application Data

(63) Continuation of application No. PCT/JP2017/040143, filed on Nov. 7, 2017.

(30) Foreign Application Priority Data

Nov. 7, 2016 (JP) ..... 2016-216886

(51) Int. Cl.
*G10H 1/36* (2006.01)
*G10L 25/51* (2013.01)
(Continued)

(52) U.S. Cl.
CPC ..... *G10H 1/366* (2013.01); *G10G 1/00* (2013.01); *G10H 1/00* (2013.01); *G10H 1/0008* (2013.01);
(Continued)

(58) Field of Classification Search
CPC ..... G10H 1/366; G10H 1/00; G10H 1/0008; G10H 2210/005; G10H 2210/076; G10G 1/00; G10L 25/51
(Continued)

(56) References Cited

U.S. PATENT DOCUMENTS 5,913,259 A 6/1999 Grubb et al.
9,069,065 B1 * 6/2015 Coley ..... G01S 3/8006
(Continued)

FOREIGN PATENT DOCUMENTS

JP 2001-117580 A 4/2001
JP 2007-241181 A 9/2007
(Continued)

OTHER PUBLICATIONS

International Search Report in PCT/JP2017/040143 dated Jan. 30, 2018.
(Continued)

*Primary Examiner* — Jianchun Qin
(74) *Attorney, Agent, or Firm* — Global IP Counselors, LLP

(57) ABSTRACT

An audio analysis method includes calculating, from an audio signal, a sound generation probability distribution which is a distribution of probabilities that sound representing the audio signal is generated at each position in a music piece, estimating, from the sound generation probability distribution, a sound generation position of the sound in the music piece, and calculating, from the sound generation probability distribution, an index of validity of the sound generation probability distribution.

14 Claims, 4 Drawing Sheets

(51) Int. Cl.
*G10H 1/00* (2006.01)
*G10G 1/00* (2006.01)

(52) U.S. Cl.
CPC ..... *G10L 25/51* (2013.01); *G10H 2210/005* (2013.01); *G10H 2210/076* (2013.01)

(58) Field of Classification Search
USPC ..... 84/610
See application file for complete search history.

(56) References Cited

U.S. PATENT DOCUMENTS

| | | | | |
|---|---|---|---|---|
| 2010/0170382 | A1* | 7/2010 | Kobayashi | G10H 1/38 84/613 |
| 2011/0214554 | A1 | 9/2011 | Nakadai et al. | |
| 2013/0231761 | A1* | 9/2013 | Eronen | G10L 25/54 700/94 |

FOREIGN PATENT DOCUMENTS

| | | | |
|---|---|---|---|
| JP | 2011-180590 | A | 9/2011 |
| JP | 2012-168538 | A | 9/2012 |
| JP | 2015-079183 | A | 4/2015 |

OTHER PUBLICATIONS

Translation of Office Action in the corresponding Japanese Patent Application No. 2016-216886, dated Sep. 2, 2020.

* cited by examiner

AUDIO ANALYSIS METHOD AND AUDIO ANALYSIS DEVICE

CROSS-REFERENCE TO RELATED APPLICATIONS

This application is a continuation application of International Application No. PCT/JP2017/040143, filed on Nov. 7, 2017, which claims priority to Japanese Patent Application No. 2016-216886 filed in Japan on Nov. 7, 2016. The entire disclosures of International Application No. PCT/JP2017/040143 and Japanese Patent Application No. 2016-216886 are hereby incorporated herein by reference.

BACKGROUND

Technological Field

The present invention relates to a technology for analyzing audio signals.

Background Information

A score alignment technique for estimating a position in a music piece at which sound is actually being generated (hereinafter referred to as "sound generation position") by means of analyzing an audio signal that represents the sound that is generated by the performance of the music piece has been proposed in the prior art. For example, Japanese Laid-Open Patent Application No. 2015-79183 discloses a configuration for calculating the likelihood (observation likelihood) that each time point in a music piece corresponds to the actual sound generation position by means of analyzing an audio signal, to thereby calculate the posterior probability of the sound generation position by means of updating the likelihood using a hidden semi-Markov model (HSMM).

It should be noted in passing that, in practice, it is difficult to completely eliminate the possibility of the occurrence of an erroneous estimation of the sound generation position. Thus, in order, for example, to predict the occurrence of an erroneous estimation and carry out appropriate countermeasures in advance, it is important to quantitatively evaluate the validity of a probability distribution of the posterior probability.

SUMMARY

In consideration of such circumstances, an object of a preferred aspect of the present disclosure is to appropriately evaluate the validity of the probability distribution relating to the sound generation position.

In order to solve the problem described above, in an audio analysis method according to a preferred aspect of this disclosure, a sound generation probability distribution which is a distribution of probabilities that sound representing an audio signal is generated at each position in a music piece, is calculated from the audio signal, a sound generation position of the sound in the music piece is estimated from the sound generation probability distribution, and an index of validity of the sound generation probability distribution is calculated from the sound generation probability distribution.

An audio analysis device according to a preferred aspect of this disclosure comprises a distribution calculation module that calculates a sound generation probability distribution which is a distribution of probabilities that sound representing an audio signal is generated at each position in a music piece, from the audio signal; a position estimation module that estimates a sound generation position of the sound in the music piece from the sound generation probability distribution; and an index calculation module that calculates an index of validity of the sound generation probability distribution from the sound generation probability distribution.

DETAILED DESCRIPTION OF THE EMBODIMENTS

Selected embodiments will now be explained with reference to the drawings. It will be apparent to those skilled in the field of musical performances from this disclosure that the following descriptions of the embodiments are provided for illustration only and not for the purpose of limiting the invention as defined by the appended claims and their equivalents.

First Embodiment

Figure 1:
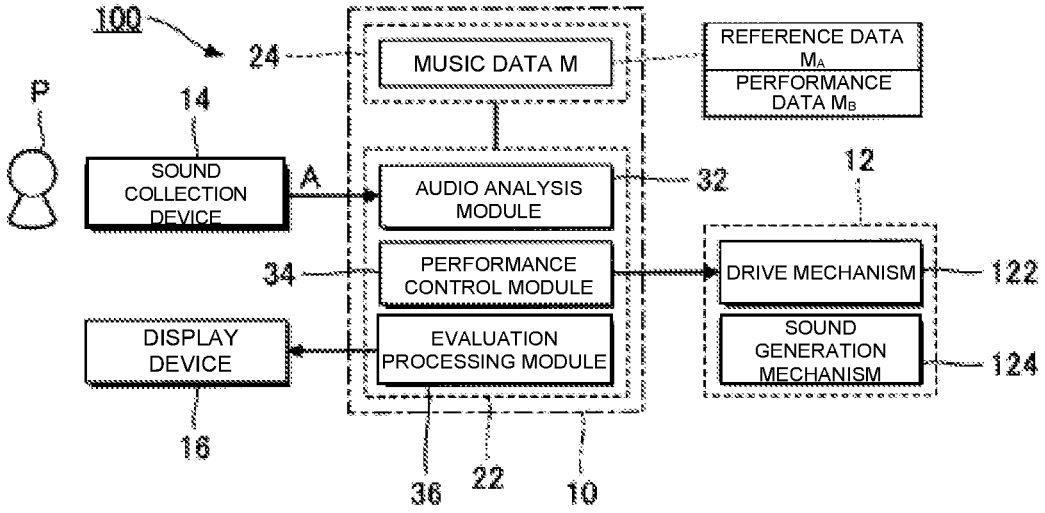
FIG. 1 is a block diagram of an automatic performance system according to a preferred embodiment.

FIG. 1 is a block diagram of an automatic performance system 100 according to a first embodiment. The automatic performance system 100 is a computer system that is installed in a space in which a performer P plays a musical instrument, such as a music hall, and that executes, parallel with the performance of a music piece by the performer P (hereinafter referred to as "target music piece"), an automatic performance of the target music piece. Although the performer P is typically a performer of a musical instrument, the performer P can also be a singer of the target music piece.

As shown in FIG. 1, the automatic performance system 100 according to the first embodiment comprises an audio analysis device 10, a performance device 12, a sound collection device 14, and a display device 16. The audio analysis device 10 is a computer system that controls each element of the automatic performance system 100 and is realized by an information processing device, such as a personal computer.

The performance device 12 executes an automatic performance of a target music piece under the control of the audio analysis device 10. From among the plurality of parts that constitute the target music piece, the performance device 12 according to the first embodiment executes an automatic performance of parts other than the parts performed by the performer P. For example, a main melody part of the target music piece is performed by the performer P, and the automatic performance of an accompaniment part of the target music piece is executed by the performance device 12.

As shown in FIG. 1, the performance device 12 of the first embodiment is an automatic performance instrument (for example, an automatic piano) comprising a drive mechanism 122 and a sound generation mechanism 124. In the same manner as a keyboard instrument of a natural musical instrument, the sound generation mechanism 124 has, associated with each key, a string striking mechanism that causes a string (sound-generating body) to generate sounds in conjunction with the displacement of each key of a keyboard. The string striking mechanism corresponding to any given key comprises a hammer that is capable of striking a string and a plurality of transmitting members (for example, whippens, jacks, and repetition levers) that transmit the displacement of the key to the hammer. The drive mechanism 122 executes the automatic performance of the target music piece by driving the sound generation mechanism 124. Specifically, the drive mechanism 122 is configured comprising a plurality of driving bodies (for example, actuators, such as solenoids) that displace each key, and a drive circuit that drives each driving body. An automatic performance of the target music piece is realized by the drive mechanism 122 driving the sound generation mechanism 124 in, accordance with instructions from the audio analysis device 10. The audio analysis device 10 can also be mounted on the performance device 12.

The sound collection device 14 generates an audio signal A by collecting, sounds generated by the performance by the performer P (for example, instrument sounds or singing sounds). The audio signal A represents the waveform of the sound. Moreover, an audio signal A that is output from an electric musical instrument, such as an electric string instrument, can also be used. Therefore, the sound collection device 14 can be omitted. The audio signal A can also be generated by adding signals that are generated by a plurality of the sound collection devices 14. The display device 16 (for example, a liquid-crystal display panel) displays various images under the control of the audio analysis device 10.

As shown in FIG. 1, the audio analysis device 10 is realized by a computer system comprising an electronic controller 22 and a storage device 24. The term "electronic controller" as used herein refers to hardware that executes software programs. The electronic controller 22 includes a processing circuit, such as a CPU (Central Processing Unit) having at least one processor that comprehensively controls the plurality of elements (performance device 12, sound collection device 14, and display device 16) that constitute the automatic performance system 100. The electronic controller 22 can be configured to comprise, instead of the CPU or in addition to the CPU, programmable logic devices such as a DSP (Digital Signal Processor), an FPGA (Field Programmable Gate Array), and the like. In addition, the electronic controller 22 can include a plurality of CPUs (or a plurality of programmable logic devices). The storage device 24 is configured from a known storage medium, such as a magnetic storage medium or a semiconductor storage medium, or from a combination of a plurality of types of storage media, and stores a program that is executed by the electronic controller 22, and various data that are used by the electronic controller 22. The storage device 24 is any computer storage device or any computer readable medium with the sole exception of a transitory, propagating signals. For example, the storage device 24 can be a computer memory device which can be nonvolatile memory and volatile memory. Moreover, the storage device 24 that is separate from the performance system 100 (for example, cloud storage) can be prepared, and the electronic controller 22 can execute reading from and writing to the storage device 24 via a communication network, such as a mobile communication network or the Internet. That is, the storage device 24 can be omitted from the automatic performance system 100.

The storage device 24 of the first embodiment stores music data M. The music data M is in the form of ten SMF (Standard MIDI File) file conforming to the MIDI (Musical Instrument Digital Interface) standard, which designates the performance content of the target music piece. As shown in FIG. 1, the music data M of the first embodiment includes reference data MA and performance data MB.

The reference data MA designates performance content of part of the target music piece to be performed by the performer P (for example, a sequence of notes that constitute the main melody part of the target music piece). The performance data MB designates performance content of part of the target music piece that is automatically performed by the performance device 12 (for example, a sequence of notes that constitute the accompaniment part of the target music piece). Each of the reference data MA and the performance data MB is time-series data, in which are arranged, in a time series, instruction data designating performance content (sound generation/mute) and time data designating the generation time point of said instruction data. The instruction data assigns pitch (note number) and intensity (velocity), and provide instruction for various events, such as sound generation and muting. The time data, on the other hand, designates, for example, an interval for successive instruction data.

The electronic controller 22 has a plurality of functions for realizing the automatic performance of the target music piece (audio analysis module 32; performance control module 34; and evaluation processing module 36) by the execution of a program that is stored in the storage device 24. Moreover, a configuration in which the functions of the electronic controller 22 are realized by a group of a plurality of devices (that is, a system) or a configuration in which some or all of the functions of the electronic controller 22 are realized by a dedicated electronic circuit can also be employed. In addition, a server device, which is located away from the space in which the performance device 12 and the sound collection device 14 are installed, such as a music hall, can realize some or all of the functions of the electronic controller 22.

Figure 2:
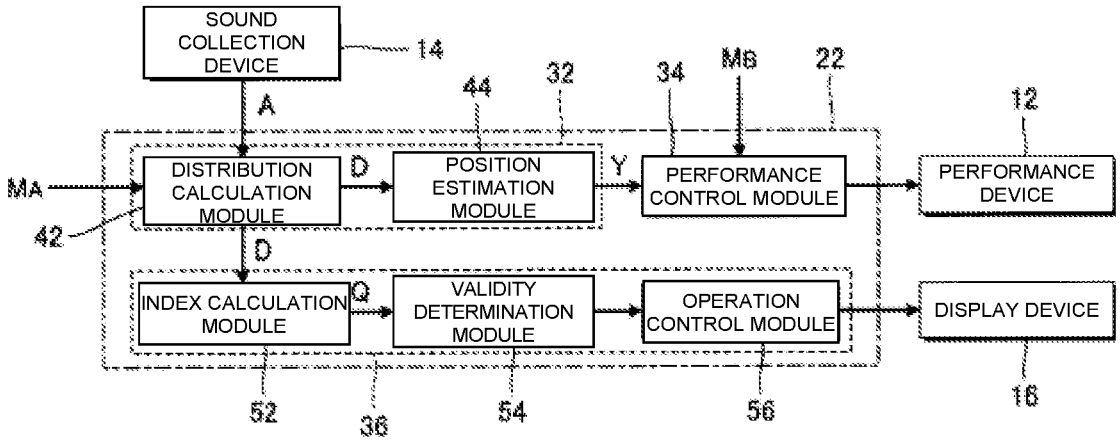
FIG. 2 is a block diagram focusing on functions of an electronic controller.

FIG. 2 is a block diagram focusing on functions of the electronic controller 22. The audio analysis module 32 estimates the position (hereinafter referred to as "sound generation position") Y in the target music piece at which sound is actually being generated by the performance of the performer P. Specifically, the audio analysis module 32 estimates the sound generation position Y by analyzing the audio signal A that is generated by the sound collection device 14. The audio analysis module 32 of the first embodiment estimates the sound generation position Y by cross-checking the audio signal A generated by the sound collection device 14 and the performance content indicated by the reference data MA in the music data M (that is, the performance content of the main melody part to be played by a plurality of performers P). The estimation of the sound generation position V by the audio analysis module 32 is repeated in real time, parallel with the performance of the performer P. For example, the estimation of the sound generation position Y is repeated at a prescribed period.

As shown in FIG. 2, the audio analysis module 32 of the first embodiment is configured comprising a distribution calculation module 42 and a position estimation module 44. The distribution calculation module 42 calculates a sound generation probability distribution D, which is the distribution of the probability (posterior probability) that sound represented by the audio signal A was generated at each position t in the target music piece. The calculation of the sound generation probability distribution D by the distribution calculation module 42 is sequentially carried out for each unit segment (frames), where the segments are obtained by dividing the audio signal A on the time axis. The unit segment is a segment of prescribed length. Consecutive unit segments can overlap on the time axis.

Figure 3:
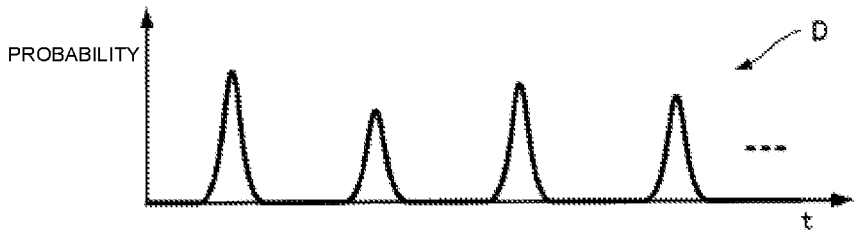
FIG. 3 is an explanatory view of a sound generation probability distribution.

FIG. 3 is an explanatory view of the sound generation probability distribution D. As shown in FIG. 3, the sound generation probability distribution D of one random unit segment is the probability distribution obtained by arranging the probability that an arbitrary position t in the target music piece corresponds to the sound generation position of the sound represented by the audio signal A of said unit segment, for a plurality of positions t in the target music piece. That is, the position t in the sound generation probability distribution D that has a high probability is highly likely to correspond to the sound generation position of the sound represented by the audio signal A of one unit segment. Therefore, out of the plurality of positions t of the target music piece, there could be a peak at the position t that is more likely to correspond to the sound generation position of one unit segment. For example, there is a peak corresponding to each of a plurality of segments in which the same melody is repeated in the target music piece. That is, as shown in FIG. 3, the sound generation probability distribution D can contain a plurality of peaks. A random position (a point on the time axis) t in the target music piece can be expressed, for example, by using a MIDI tick number starting at the beginning of the target music piece.

Specifically, the distribution calculation module 42 of the first embodiment crosschecks the audio signal A of each unit segment and the reference data MA of the target, music piece to thereby calculate the likelihood (observation likelihood) that the sound generation position of the unit segment corresponds to each position t in the target music piece. Then, under the condition that the unit segment of the audio signal A has been observed, the distribution calculation module 42 calculates, as the sound generation probability distribution D, the probability distribution of the posterior probability (posterior distribution) that the time point of the sound generation of said unit segment was the position t in the target music piece, from the likelihood for each position t. Known statistical processing, such as Bayesian estimation using a hidden semi-Markov model (HSMM) can be suitably used for calculating the sound generation probability distribution D that uses the observation likelihood, as disclosed in, for example, Patent Document 1.

The position estimation module 44 estimates the sound generation position Y of the sound represented by the unit segment of the audio signal A in the target music piece from the sound generation probability distribution D calculated by the distribution calculation module 42. Known statistical processing estimation methods, such as MAP (Maximum A Posteriori) estimation, can be freely used to estimate the sound generation position Y using the sound generation probability distribution D. The estimation of the sound generation position Y by the position estimation module 44 is repeated for each unit segment of the audio signal A. That is, for each of a plurality of unit segments of the audio signal A, one of a plurality of positions t of the target music piece is specified as the sound generation position Y.

The performance control module 34 of FIG. 2 causes the performance device 12 to execute the automatic performance corresponding to the performance data MB in the music data M. The performance control module 34 of the first embodiment causes the performance device 12 to execute the automatic performance so as to be synchronized with the progression of the sound generation position Y (movement on a time axis) that is estimated by the audio analysis module 32. Specifically, the performance control module 34 instructs the performance device 12 of the performance content specified by the performance data MB with respect to the point in time that corresponds to the sound generation position Y in the target music piece. In other words, the performance control module 34 functions as a sequencer that sequentially supplies each piece of instruction data included in the performance data MB to the performance device 12.

The performance device 12 executes the automatic performance of the target music piece in accordance with the instructions from the performance control module 34. Since the sound generation position Y moves with time toward the end of the target music piece as the performance of the performer P progresses, the automatic performance of the target music piece by the performance device 12 will also progress with the movement of the sound generation position Y. That is, the automatic performance of the target music piece by the performance device 12 is executed at the same tempo as that of the performance of the performer P. As can be understood from the foregoing explanation, in order to synchronize the automatic performance with the performance of the performer P, the performance control module 34 provides instruction to the performance device 12 for carrying out the automatic performance in accordance with the content specified by the performance data MB while maintaining the intensity of each note and the musical expressions, such as phrase expressions, of the target music piece. Thus, for example, if performance data MB that represents the performance of a specific performer, such as a performer of the past who is no longer alive, are used, it is possible to create an atmosphere as if the performer were cooperatively and synchronously playing together with a plurality of actual performers P, while accurately reproducing musical expressions that are unique to said performer by means of the automatic performance.

Moreover, in practice, time on the order of several hundred milliseconds is required for the performance device 12 to actually generate a sound (for example, for the hammer of the sound generation mechanism 124 to strike a string), after the performance control module 34 provides instruction to the performance device 12 to carry out the automatic performance by means of an output of instruction data in the performance data MB. That is, the actual generation of sound by the performance device 12 can be delayed with respect to the instruction from the performance control module 34. Therefore, the performance control module 34 can also provide instruction to the performance device 12 regarding the performance at a (future) point in time that is subsequent to the sound generation position Y in the target music piece estimated by the audio analysis module 32.

The evaluation processing module 36 of FIG. 2 evaluates the validity of the sound generation probability distribution D calculated by the distribution calculation module 42 for each unit segment. The evaluation processing module 36 of the first embodiment is configured including an index calculation module 52, a validity determination module 54, and an operation control module 56. The index calculation module 52 calculates an index Q of the validity of the sound generation probability distribution D calculated by the distribution calculation module 42 from the sound generation probability distribution D. The calculation of the index Q by the index calculation module 52 is executed for each sound generation probability distribution D (that is, for each unit segment).

Figure 4:
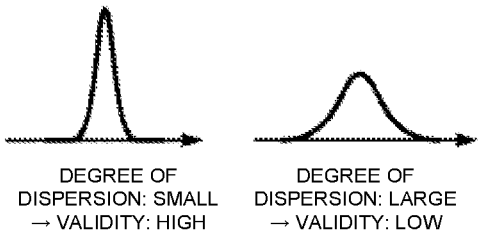
FIG. 4 is an explanatory view of an index of validity of the sound generation probability distribution in a first embodiment.

FIG. 4 is a schematic view of one arbitrary peak of the sound generation probability distribution D. As shown in FIG. 4, the validity of the sound generation probability distribution U tends to become higher as the degree of dispersion d of the peak of the sound generation probability distribution D becomes smaller (that is, as the range of the peak becomes narrower). The degree of dispersion d is a statistic that indicates the degree of scattering of probability values, for example, the variance or standard deviation. It can also be said that as the degree of dispersion d of the peak of the sound generation probability distribution D becomes smaller, the position t in the target music piece corresponding to said peak is more likely to correspond to the sound generation position.

Based on the tendency described above, the index calculation module 52 calculates the index Q in accordance with the shape of the sound generation probability distribution D. The index calculation module 52 of the first embodiment calculates the index Q in accordance with the degree of dispersion d at the peak of the sound generation probability distribution D. Specifically, the index calculation module 52 calculates as the index Q the variance of one peak that is present in the sound generation probability distribution D (hereinafter referred to as "selected peak"). Thus, the validity of the sound generation probability distribution D can be evaluated as increasing as the index Q becomes smaller (that is, the selected peak becomes sharper). If, as shown in FIG. 3, a plurality of peaks are present in the sound generation probability distribution D, the index is calculated using the one peak that has the largest local maximum value as the selected peak. It is also possible to select, from among the plurality of peaks of the sound generation probability distribution D, the peak at a position t that is closest to the sound generation position Y of the immediately preceding unit segment as the selected peak. In addition, it is also possible to use a configuration in which a representative value (for example, the mean) of the degrees of dispersion d of a plurality of selected peaks that are ranked high in an array sorted in descending order from local maximum value is calculated as the index Q.

The validity determination module 54 of FIG. 2 determines the presence/absence (presence or absence) of validity of the sound generation probability distribution D based on the index Q calculated by the index calculation module 52. As described above, the validity of the sound generation probability distribution D tends to be higher as the index Q becomes smaller. Given the tendency described above, the validity determination module 54 of the first embodiment determines the presence/absence of validity of the sound generation probability distribution D in accordance with the result of comparing the index Q with a prescribed threshold value QTH. The validity determination module 54 can compare the index Q with the prescribed threshold value QTH. Specifically, the validity determination module 54 determines that the sound generation probability distribution D is valid when the index Q is lower than the threshold value QTH, and determines that the sound generation probability distribution D is not valid when the index Q is higher than the threshold value QTH. The validity determination module 54 can determine that the sound generation probability distribution D is valid when the index Q is equal to or lower than the threshold value QTH and determine that the sound generation probability distribution D is not valid when the index Q is higher than the threshold value QTH. The validity determination module 54 can determine that the sound generation probability distribution D is valid when the index Q is lower than the threshold value QTH and determine that the sound generation probability distribution D is not valid when the index Q is equal to or higher than the threshold value QTH. The threshold value QTH can be selected experimentally or statistically, for example, such that a target estimation accuracy is achieved when the sound generation position Y is estimated using the sound generation probability distribution D that is deemed valid.

The operation control module 56 controls the operation of the automatic performance system 100 in accordance with the determination result of the validity determination module 54 (presence/absence of validity of the sound generation probability distribution D). When the validity determination module 54 determines that the sound generation probability distribution D is not valid, the operation control module 56 of the first embodiment notifies the user to that effect. Specifically, the operation control module 56 causes the display device 16 to display a message indicating that the sound generation probability distribution D is not valid. The message can be a character string, such as "the estimation accuracy of the performance position has decreased," or the message can report the decline in the estimation accuracy by means of a color change. By visually checking the display of the display device 16, the user can ascertain that the automatic performance system 100 is not able to estimate the sound generation position Y with sufficient accuracy. In the foregoing description, the determination result by the validity determination module 54 is visually reported to the user by means of an image display, but it is also possible to audibly notify the user of the determination result by means of sound, for example. For instance, the operation control module 56 reproduces sound from a sound-emitting device, such as a loudspeaker or an earphone. The sound can be an announcement, such as "the estimation accuracy of the performance position has decreased," or can be an alarm.

Figure 5:
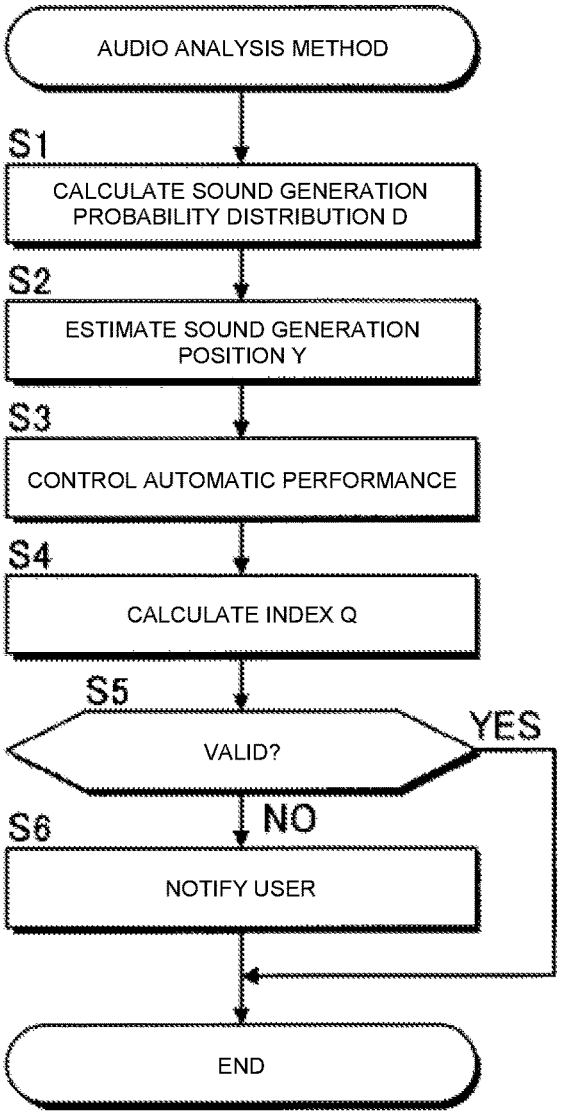
FIG. 5 is a flowchart illustrating an operation of the electronic controller.

FIG. 5 is a flowchart illustrating an operation (audio analysis method) of the electronic controller 22. The process of FIG. 5 is executed for each unit segment of the audio signal A. When the process of FIG. 5 is started, the distribution calculation module 42 calculates the sound generation probability distribution D by means of analyzing the audio signal A in one unit segment to be processed (S1). The position estimation module 44 estimates the sound generation position Y from the sound generation probability distribution D (S2). The performance control module 34 causes the performance device 12 to execute the automatic performance of the target music piece so that the automatic performance is synchronized with the sound generation position Y estimated by the position estimation module 44 (S3).

The index calculation module 52 calculates the index Q of the validity of the sound generation probability distribution D calculated by the distribution calculation module 42 (S4). Specifically, the degree of dispersion d of the selected peak of the sound generation probability distribution D is calculated as the index Q. The validity determination module 54 determines the presence/absence of validity of the sound generation probability distribution D based on the index Q (S5). Specifically, the validity determination module 54 determines whether the index Q is lower than the threshold value QTH.

If the index Q exceeds the threshold value QTH (Q>QTH), that the sound generation probability distribution D is not valid can be tested. If the validity determination module 54 determines that the sound generation probability distribution D is not valid (S5: NO), the operation control module 56 notifies the user that the sound generation probability distribution D is not valid (S6). On the other hand, if the index Q is below the threshold value QTH (Q<QTH), it can be determined whether the sound generation probability distribution D is valid. If the validity determination module 54 determines that the sound generation probability distribution D is valid (S5: YES), the operation (S6) to report the sound generation probability distribution D as not valid is not executed. However, if the validity determination module 54 determines that the sound generation probability distribution D is valid, the operation control module 56 can notify the user to that effect.

As described above, in the first embodiment, the index Q of the validity of the sound generation probability distribution D is calculated from the sound generation probability distribution D. Thus, it is possible to quantitatively evaluate the validity of the sound generation probability distribution D (and, thus, the validity of the sound generation position Y that can be estimated front the sound generation probability distribution D). In the first embodiment, the index Q is calculated in accordance with the degree of dispersion d (for example, variance) at the peak of the sound generation probability distribution D. Accordingly, it is possible to calculate the index Q, which can highly accurately test the validity of the sound generation probability distribution D, based on the tendency that the validity (statistical reliability) of the sound generation probability distribution D increases as the degree of dispersion d of the peak of the sound generation probability distribution D becomes smaller.

In addition, in the first embodiment, the user is notified of the determination result that the sound generation probability distribution is not valid. The user might therefore respond by changing the automatic control that utilizes the estimation result of the sound generation position Y to manual control.

Second Embodiment

A second embodiment now be described. In each of the embodiments illustrated below, elements that have the same actions or functions as in the first embodiment have been assigned the same reference symbols as those used to describe the first embodiment, and detailed descriptions thereof have been appropriately omitted.

In the automatic performance system 100 according to the second embodiment, the method with which the index calculation module 52 calculates the index Q of the validity of the sound generation probability distribution D differs from the first embodiment. The operations and configurations other than those of the index calculation module 52 are the same as in the first embodiment.

Figure 6:
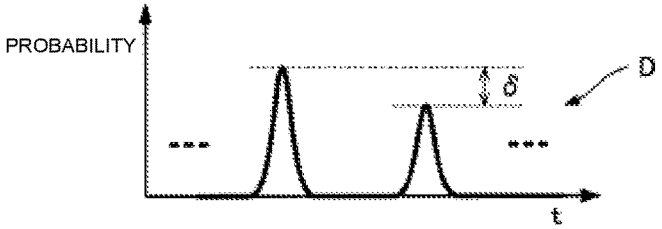
FIG. 6 is an explanatory view of an index of validity of the sound generation probability distribution in a second embodiment.

FIG. 6 is an explanatory view of an operation in which the index calculation module 52 according to the second embodiment calculates the index Q. As shown in FIG. 6, a plurality of peaks having different local maximum values can be present in the sound generation probability distribution D. In the sound generation probability distribution D that can specify the appropriate sound generation position Y with high accuracy, the local maximum value of the peak at the position t corresponding to said sound generation position Y tends to be greater than the local maximum values of the other peaks. That is, it the validity (statistical reliability) of the sound generation probability distribution D can be evaluated as increasing as the local maximum value of a specific peak of the sound generation probability distribution D increases with respect to the local maximum value of another peak, Based on this tendency, the index calculation module 52 according to the second embodiment calculates the index Q in accordance with the difference δ between the local maximum value of the maximum peak of the sound generation probability distribution and the local maximum value of another peak.

Specifically, the index calculation module 52 calculates as the index Q the difference δ between the highest peak (that is, the maximum peak) and the second highest peak from an array of local maximum values of a plurality of peaks of the sound generation probability distribution D sorted in descending order. However, the method for calculating the index Q in the second embodiment is not limited to the example described above. For example, the differences δ between the local maximum values of the maximum peak and each of the remaining plurality of peaks in the sound generation probability distribution D can be calculated, and a representative value (for example, the mean) of the plurality of differences δ can be calculated as the index Q.

As described above, in the second embodiment, it is assumed that the validity of the sound generation probability distribution tends to increase as the index Q becomes larger. In light of this tendency, the validity determination module 54 of the second embodiment determines the presence/absence of validity of the sound generation probability distribution D in accordance with the result of comparing the index Q with the threshold value QTH. The validity determination module 54 can compare the index Q with the threshold value QTH. Specifically, the validity determination module 54 determines that the sound generation probability distribution D is valid when the index Q exceeds the threshold value QTH (S5: YES) and determines that the sound generation probability distribution D is not valid when the index Q is below the threshold value QTH (S5: NO). The validity determination module 54 can determine that the sound generation probability distribution is valid when the index Q is equal to or higher than the threshold value QTH and determine that the sound generation probability distribution D is not valid when the index Q is lower than the threshold value QTH. The validity determination module 54 can determine that the sound generation probability distribution D is valid when the index Q is higher than the threshold value QTH and determine that the sound generation probability distribution D is not valid when the index Q is equal to or lower than the threshold value QTH. The other operations are the same as in the first embodiment.

In the second embodiment as well, since the index Q of the validity of the sound generation probability distribution D is calculated from the sound generation probability distribution D, there is the advantage that it is possible to quantitatively evaluate the validity of the sound generation probability distribution D (and, thus, the validity of the sound generation position Y that can be estimated from the sound generation probability distribution D) in the same manner as in the first embodiment. In addition, in the second embodiment the index Q is calculated in accordance with the differences δ between the local maximum values of the peaks of the sound generation probability distribution D. Accordingly, based on the tendency for the validity of the sound generation probability distribution D to increase as the local maximum value of a specific peak of the sound generation probability distribution D becomes greater than the local maximum values of the other peaks (that is, the difference δ is larger), it is possible to calculate the index Q that can evaluate the validity of the sound generation probability distribution D with great accuracy.

Third Embodiment

Figure 7:
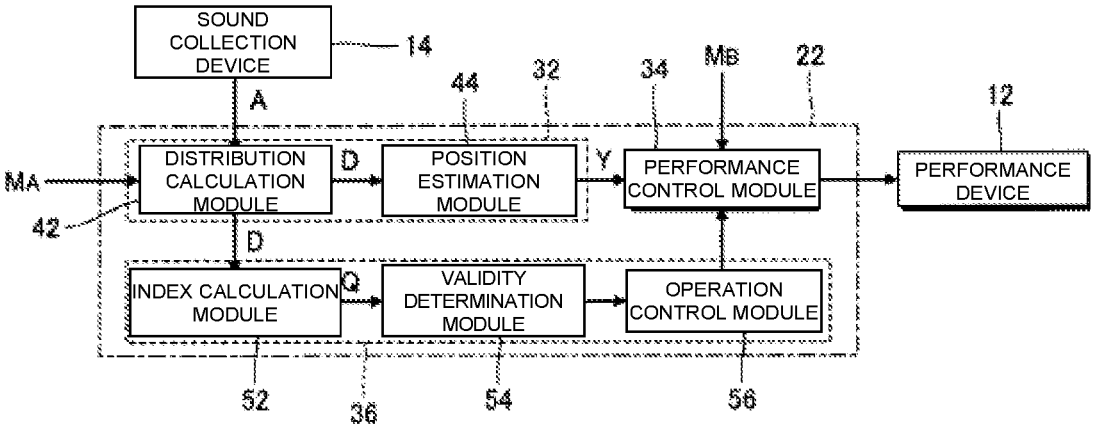
FIG. 7 is a block diagram focusing on functions of an electronic controller according to a third embodiment.

FIG. 7 is a block diagram that highlights the functions of the electronic controller 22 in a third embodiment. In the first embodiment, a configuration was presented in which the operation control module 56 notifies the user that the sound generation probability distribution D is not valid. The operation control module 56 according to the third embodiment controls the operation in which the performance control module 34 executes the automatic performance of the performance device 12 (that is, the control of the automatic performance) in accordance with the determination result of the validity determination module 54. Accordingly, the display device 16 can be omitted. However, it is likewise possible to use the above-described configuration in which the user is notified that the sound generation probability distribution D is not valid in the third embodiment as well.

Figure 8:
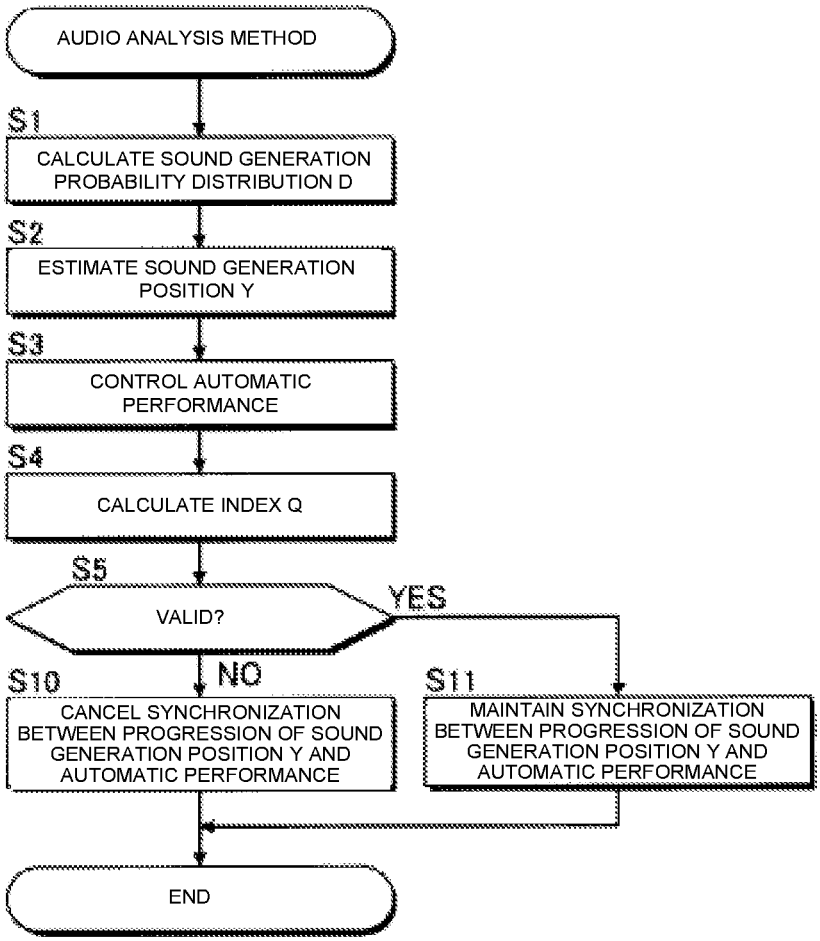
FIG. 8 is a flowchart illustrating an operation of the electronic controller according to the third embodiment.

FIG. 8 is a flowchart illustrating the operation of the electronic controller 22 (audio analysis method) according to the third embodiment. The process of FIG. 8 is executed for each unit segment of the audio signal A. The calculation of the sound generation probability distribution (S1), the estimation of the sound generation position Y (S2), and the control of the automatic performance (S3) are the same as in the first embodiment. The index calculation module 52 calculates the index Q of the validity of the sound generation probability distribution D (S4). For example, the process of the first embodiment, in which the index Q can be calculated in accordance with the degree of dispersion d of the selected peaks of the sound generation probability distribution D, or the process of the second embodiment can be suitably employed, where the index Q is calculated in accordance with the differences δ between the local maximum values of the peaks of the sound generation probability distribution D. The validity determination module 54 determines the presence/absence of validity of the sound generation probability distribution D based on the index Q, in the same manner as in the first embodiment or the second embodiment (S5).

If the validity determination module 54 determines that the sound generation probability distribution D is not valid (S5: NO), the operation control module 56 cancels the control in which the performance control module 34 synchronizes the automatic performance of the performance device 12 with the progression of the sound generation position Y (S10). For example, the performance control module 34 can set the tempo of the automatic performance of the performance device 12 to a tempo that is unrelated to the progression of the sound generation position Y in accordance with an instruction from the operation control module 56. For example, the performance control module 34 can control the performance device 12 so that the automatic performance is executed at the tempo immediately before it was determined by the validity determination module 54 that the sound generation probability distribution D is not valid, or at a standard tempo designated by the music data M (S3). If, on the other hand, the validity determination module 54 determines that the sound generation probability distribution D is valid (S5: YES), the operation control module 56 causes the performance control module 34 to continue the control to synchronize the automatic performance with the progression of the sound generation position Y (S11). Accordingly, the performance control module 34 controls the performance device 12 such that the automatic performance is synchronized with the progression of the sound generation position Y (S3).

The same effects as those of the first embodiment or the second embodiment are also achieved in the third embodiment. In the third embodiment as well, if the validity determination module 54 determines that the sound generation probability distribution D is not valid, the control to synchronize the automatic performance with the progression of the sound generation position Y is canceled. Thus, the possibility that the sound generation position Y estimated from the sound generation probability distribution D with a low validity (for example, an erroneously estimated sound generation position Y) will be reflected in the automatic performance can be reduced.

Modified Example

The embodiment illustrated above can be variously modified. Specific modified embodiments are illustrated below. Two or more embodiments arbitrarily selected from the following examples can be appropriately combined as long as they are not mutually contradictory.

(1) In the first embodiment, the degree of dispersion d (for example, variance) of the peak of the sound generation probability distribution D is calculated as the index Q, but the method for calculating the index Q based on the degree of dispersion d is not limited to the this particular example. For instance, the index Q can also be found by means of a prescribed calculation that uses the degree of dispersion d. As can be understood from the foregoing example, calculating the index Q in accordance with the degree of dispersion d at the peak of the sound generation probability distribution D includes, in addition to the configuration in which the degree of dispersion d is calculated as the index Q (Q=d), configuration in which the index Q that differs from the degree of dispersion d (Q≠d) can be calculated in accordance with said degree of dispersion d.

(2) in the second embodiment, the differences δ between the local maximum values of the peaks of the sound generation probability distribution D is calculated as the index Q, but the method for calculating the index Q in accordance with the difference δ is not limited to the foregoing example. For example, it is also possible to calculate the index Q by means of a prescribed calculation that uses the difference δ. As can be understood from the foregoing example, calculating the index Q in accordance with the differences δ between the local maximum values of the peaks of the sound generation probability distribution D includes, in addition to the configuration in which the difference δ is calculated as the index Q (Q=δ), a configuration in which the index Q that is different from the difference δ (Q≠δ) is calculated in accordance with said difference δ.

(3) In the embodiments described above, the presence/absence of the validity of the sound generation probability distribution D is determined based on the index Q, but the determination of the presence/absence of the validity of the sound generation probability distribution D can be omitted. For example, the determination of the presence/absence of validity of the sound generation probability distribution D is not necessary in a configuration in which the index Q calculated by the index calculation module 52 is reported to the user by means of an image display or by outputting sound, or in a configuration in which the time series of the index Q is stored in the storage device 24 as a history. As can be understood from the foregoing example, the validity determination module 54 exemplified in each of the above-described embodiments and the operation control module 56 can be omitted from the audio analysis device 10.

(4) In the embodiments described above, the distribution calculation module 42 calculates the sound generation probability distribution D over the entire segment of the target music piece, but the distribution calculation module 42 can also calculate the sound generation probability distribution D over a partial segment of the target music piece. For example, the distribution calculation module 42 calculates the sound generation probability distribution D with respect to a partial segment of the target music piece located in the vicinity of the sound generation position Y estimated for the immediately preceding unit segment (that is, the probability distribution at each position tin said segment).

(5) In the embodiments described above, the sound generation position Y estimated by the position estimation module 44 is used by the performance control module 34 to control the automatic performance, but the use of the sound generation position Y is not limited in this way. For example, it is possible to play the target music piece by supplying music data representing sounds of the performance of the target music piece to a sound-emitting device (for example, a loudspeaker or an earphone) so as to be synchronized with the progression of the sound generation position Y. In addition, it is possible to calculate the tempo of the performance of the performer P from the temporal change of the sound generation position Y, and to evaluate the performance from the calculation result (for example, to determine the presence/absence of a change in tempo). As can be understood from the foregoing example, the performance control module 34 can be omitted from the audio analysis device 10.

(6) As exemplified in the above-described embodiments, the audio analysis device 10 is realized by cooperation between the electronic controller 22 and the program. The program according to a preferred aspect of causes a computer to function as the distribution calculation module 42 for calculating the sound generation probability distribution D, which is a distribution of probabilities that sound representing the audio signal A is generated at each position t in the target music piece from the audio signal A; as the position estimation module 44 for estimating the sound generation position Y of the sound in the target music piece from the sound generation probability distribution D; and as the index calculation module 52 for calculating the index Q of the validity of the sound generation probability distribution D from the sound generation probability distribution D. The program exemplified above can be stored on a computer-readable storage medium and installed in the computer.

The storage medium is, for example, a non-transitory (non-transitory) storage medium, a good example of which is an optical storage medium, such as a CD-ROM, but can include other known arbitrary storage medium formats, such as semiconductor storage media and magnetic storage media. "Non-transitory storage media" include any computer-readable storage medium that excludes transitory propagation signals (transitory propagation signal) and does not exclude volatile storage media. Furthermore, it is also possible to deliver the program to a computer in the form of distribution via a communication network.

(7) For example, the following configurations can be understood from the embodiments exemplified above.

First Aspect

In an audio analysis method according to a preferred aspect (first aspect), a computer system calculates from an audio signal a sound generation probability distribution, which is a distribution of probabilities that sound representing the audio signal is generated at each position in a music piece, estimates the sound generation position of the sound in the music piece from the sound generation probability distribution, and calculates an index of the validity of the sound generation probability distribution from the sound generation probability distribution. In the first aspect, the index of the validity of the sound generation probability distribution is calculated from the sound generation probability distribution. Thus, it is possible to quantitatively evaluate the validity of the sound generation probability distribution (and, hence, the validity of the result of estimating the sound generation position from the sound generation probability distribution).

Second Aspect

In a preferred example (second aspect) of the first aspect, when calculating the index, the index is calculated in accordance with the degree of dispersion at a peak of the sound generation probability distribution. It is assumed that the validity (statistical reliability) of the sound generation probability distribution tends to increase as the degree of dispersion (for example, variance) of the peak of the sound generation probability distribution decreases. If this tendency is assumed, by means of the second aspect in which the index is calculated in accordance with the degree of dispersion of the peak of the sound generation probability distribution, it is possible to calculate the index that can evaluate the validity of the sound generation probability distribution with high accuracy. For example, in a configuration in which the degree of dispersion of the peaks of the sound generation probability distribution is calculated as the index, the sound generation probability distribution can be evaluated as being valid when the index is below the threshold value (for example, when the variance is small), and the sound generation probability distribution can be evaluated as not being valid when the index is higher than the threshold value (for example, when the variance is large).

Third Aspect

In a preferred example (third aspect) of the first aspect, when calculating the index, the index is calculated in accordance with the difference between a local maximum value of maximum peaks of the sound generation probability distribution and the local maximum value of another peak. It is assumed that the validity (statistical reliability) of the sound generation probability distribution tends to increase as the local maximum value of a specific peak of the sound generation probability distribution increases with respect to the local maximum value of the other peak. If the tendency described above is assumed, by means of the third aspect, in which the index is calculated in accordance with the difference between the local maximum value at the maximum peak and the local maximum value at the other peak, it is possible to calculate the index that can test the validity of the sound generation probability distribution with high accuracy. For example, in a configuration in which the difference between the local maximum value at the maximum peak and the local maximum value at another peak is calculated as the index, it is possible to determine that the sound generation probability distribution is valid when the index is greater than the threshold value and that the sound generation probability distribution is not valid when the index is below the threshold value.

Fourth Aspect

In a preferred example (fourth aspect) of any one of the first aspect to the third aspect, the computer system further determines the presence/absence of the validity of the sound generation probability distribution based cats the index. By means of the fourth aspect, it is possible to objectively determine the presence/absence of the validity of the sound generation probability distribution.

Fifth Aspect

In a preferred example (fifth aspect) of the fourth aspect, the computer system further notifies a user when it is determined that the sound generation probability distribution is not valid. In the fifth aspect, the user is notified when it is determined that the sound generation probability distribution is not valid. The user might therefore respond by changing the automatic control that utilizes the estimation result of the sound generation position to manual control Sixth Aspect hi a preferred example (sixth aspect) of the fourth aspect, the computer system further executes the automatic performance of the music piece so that the automatic performance is synchronized with the progression of the estimated sound generation position, and when it is determined that the sound generation probability distribution is not valid, the computer system cancels the control to synchronize the automatic performance with the progression of the sound generation position. In the sixth aspect, when it is determined that the sound generation probability distribution is not valid, the control to synchronize the automatic performance with the progression of the sound generation position is canceled. Accordingly, it is possible prevent a sound generation position estimated from a sound generation probability distribution of low validity (for example, an erroneously estimated sound generation position) from being reflected in the automatic performance.

Seventh Aspect

An audio analysis device according to a preferred aspect (seventh aspect) comprises a distribution calculation module that calculates from an audio signal a sound generation probability distribution, which is a distribution of probabilities that sound representing the audio signal is generated at each position in a music piece; a position estimation module that estimates the sound generation position of the sound in the music piece from the sound generation probability distribution; and an index calculation module that calculates an index of the validity of the sound generation probability distribution from the sound generation probability distribution. In the seventh aspect, the index of the validity of the sound generation probability distribution, is calculated from the sound generation probability distribution. Accordingly, it is possible to quantitatively evaluate the validity of the sound generation probability distribution (and, thus, the validity of the result of estimating the sound generation position from the sound generation probability distribution).

The present embodiments are useful because it is possible to appropriately evaluate the validity of the probability distribution relating to the sound generation position.

What is claims:

1. An audio analysis method comprising:

calculating, from an audio signal, a sound generation probability distribution which is a distribution of probabilities that sound representing the audio signal is generated at each position in a music piece;

estimating, from the sound generation probability distribution, a sound generation position of the sound in the music piece so as to synchronize automatic performance of the music piece with progress of the sound generation position;

calculating, from the sound generation probability distribution, an index of validity of the sound generation probability distribution, the index being calculated in accordance with a difference between a local maximum value at a maximum peak of the sound generation probability distribution and a local maximum value at a different peak of the sound generation probability distribution, which is different from the maximum peak;

determining a presence/absence of validity of the sound generation probability distribution based on the index; and notifying a user of the absence of validity of the sound generation probability distribution in response to determining that the sound generation probability distribution is not valid.

2. The audio analysis method according to claim 1, wherein the sound generation probability distribution is determined as being not valid in response to the index being lower than a prescribed value.

3. The audio analysis method according to claim 1, further comprising executing the automatic performance of the music piece so as to be synchronized with the progression of the sound generation position that has been estimated.

4. An audio analysis method comprising:

calculating, from an audio signal, a sound generation probability distribution which is a distribution of probabilities that sound representing the audio signal is generated at each position in a music piece;

estimating, from the sound generation probability distribution, a sound generation position of the sound in the music piece;

calculating, from the sound generation probability distribution, an index of validity of the sound generation probability distribution;

determining a presence/absence of validity of the sound generation probability distribution based on the index;

executing automatic performance of the music piece so as to be synchronized with progression of the sound generation position that has been estimated; and cancelling control to synchronize the automatic performance with the progression of the sound generation position in response to determining that the sound generation probability distribution is not valid.

5. The audio analysis method according to claim 4, wherein the index is calculated in accordance with a degree of dispersion at a peak of the sound generation probability distribution.

6. The audio analysis method according to claim 5, wherein the sound generation probability distribution is determined as being not valid in response to the index being higher than a prescribed value.

7. The audio analysis method according to claim 4, further comprising notifying a user in response to determining that the sound generation probability distribution is not valid.

8. An audio analysis device comprising:

an electronic controller including at least one processor, the electronic controller being configured to execute a plurality of modules including a distribution calculation module that calculates, from an audio signal, a sound generation probability distribution which is a distribution of probabilities that sound representing the audio signal is generated at each position in a music piece;

a position estimation module that estimates a sound generation position of the sound in the music piece from the sound generation probability distribution so as to synchronize automatic performance of the music piece with progress of the sound generation position;

an index calculation module that calculates an index of validity of the sound generation probability distribution from the sound generation probability distribution, the index calculation module calculating the index in accordance with a difference between a local maximum value at a maximum peak of the sound generation probability distribution and a local maximum value at a different peak of the sound generation probability distribution, which is different from the maximum peak;

a validity determination module that determines a presence/absence of validity of the sound generation probability distribution based on the index; and an operation control module that notifies a user of the absence of validity of the sound generation probability distribution in response to the validity determination module determining that the sound generation probability distribution is not valid.

9. The audio analysis device according to claim 8, wherein the validity determination module determines that the sound generation probability distribution is not valid in response to the index being lower than a prescribed value.

10. The audio analysis device according to claim 8, wherein the electronic controller further includes a performance control module that executes the automatic performance of the music piece so as to be synchronized with the progression of the sound generation position that has been estimated.

11. An audio analysis device comprising:

an electronic controller including at least one processor, the electronic controller being configured to execute a plurality of modules including a distribution calculation module that calculates, from an audio signal, a sound generation probability distribution which is a distribution of probabilities that sound representing the audio signal is generated at each position in a music piece;

a position estimation module that estimates a sound generation position of the sound in the music piece from the sound generation probability distribution;

an index calculation module that calculates an index of validity of the sound generation probability distribution from the sound generation probability distribution;

a validity determination module that determines a presence/absence of validity of the sound generation probability distribution based on the index;

a performance control module that executes automatic performance of the music piece so as to be synchronized with progression of the sound generation position that has been estimated; and an operation control module that cancels control of the performance control module to synchronize the automatic performance with the progression of the sound generation position in response to the validity determination module determining that the sound generation probability distribution is not valid.

12. The audio analysis device according to claim 11, wherein the index calculation module calculates the index in accordance with a degree of dispersion at a peak of the sound generation probability distribution.

13. The audio analysis device according to claim 12, wherein the validity determination module determines that the sound generation probability distribution is not valid in response to the index being higher than a prescribed value.

14. The audio analysis device according to claim 11, wherein the electronic controller further includes an operation control module that notifies a user in response to the validity determination module determining that the sound generation probability distribution is not valid.

* * * * *